United States Patent [19]

Offutt

[11] Patent Number: 4,657,249

[45] Date of Patent: Apr. 14, 1987

[54] BASKETBALL GOAL SUPPORT

[75] Inventor: James C. Offutt, Peoria, Ill.

[73] Assignee: Rimball, Inc., Peoria, Ill.

[21] Appl. No.: 761,050

[22] Filed: Jul. 31, 1985

[51] Int. Cl.[4] ..... A63B 63/08

[52] U.S. Cl. ..... 273/1.5 R; 248/206.1; 248/215; 248/536; 248/539

[58] Field of Search ..... 273/1.5 R, 1.5 A; D21/201; 248/214, 215, 206.1, 205.5, 206.4, 536, 539

[56] References Cited

U.S. PATENT DOCUMENTS

| | | | |
|---|---|---|---|
| Re. 20,898 | 10/1938 | Schabinger | 273/1.5 R |
| D. 168,846 | 2/1953 | Lincoln et al. | 248/205.5 X |
| D. 265,493 | 7/1982 | Kringlie | D21/201 |
| 1,629,576 | 5/1927 | Irish | 248/214 |
| 1,674,305 | 6/1928 | Sedlock et al. | 248/214 X |
| 2,085,206 | 6/1937 | Holmdahl | 273/1.5 R |
| 2,130,820 | 9/1938 | Trumbull | 273/1.5 R |
| 2,169,183 | 8/1939 | Fish | 248/206.4 X |
| 2,192,430 | 3/1940 | Branner | 273/1.5 R X |
| 2,194,779 | 3/1940 | Albach | 273/1.5 R |
| 2,278,616 | 4/1942 | Kettering | 273/1.5 R |
| 2,473,098 | 6/1949 | Rubin | 273/1.5 R |
| 2,512,417 | 6/1950 | Cook | 273/1.5 R |
| 2,517,463 | 8/1950 | Cobb | 273/1.5 R |
| 2,545,615 | 3/1951 | Hatley | 273/402 |
| 2,838,308 | 6/1958 | Polite | 273/1.5 R |
| 2,867,918 | 1/1959 | Miller | 248/214 X |
| 3,421,764 | 1/1969 | Smith et al. | 273/1.5 R X |
| 3,588,103 | 6/1971 | Fuller | 273/1.5 R |
| 3,602,505 | 8/1971 | Friend | 273/1.5 R |
| 3,650,530 | 3/1972 | Gantz | 273/1.5 R X |
| 3,669,450 | 6/1972 | Mason | 273/1.5 R |
| 3,749,920 | 6/1973 | Coblentz et al. | 248/214 X |
| 3,776,549 | 12/1973 | Ganis | 273/1.5 R |
| 3,814,359 | 6/1974 | Powell | 273/1.5 A X |
| 3,901,506 | 8/1975 | Caveney | 273/1.5 A |
| 3,944,178 | 3/1976 | Greenwood | 248/214 X |
| 4,005,860 | 2/1977 | Ebstein et al. | 273/1.5 R |
| 4,036,494 | 7/1977 | Hayes | 273/1.5 R |
| 4,123,030 | 10/1978 | Johansson | 248/539 X |
| 4,183,522 | 1/1980 | Killen | 273/1.5 R |
| 4,418,496 | 12/1983 | Koistinen | 248/215 X |
| 4,468,027 | 8/1984 | Pangburn | 273/1.5 R |

FOREIGN PATENT DOCUMENTS

| | | | |
|---|---|---|---|
| 1313021 | 11/1962 | France | 273/1.5 R |
| 254082 | 7/1926 | United Kingdom | 248/214 |
| 520656 | 10/1939 | United Kingdom | 273/1.5 R |

*Primary Examiner*—Paul E. Shapiro

*Attorney, Agent, or Firm*—Allegretti, Newitt, Witcoff & McAndrews, Ltd.

[57] ABSTRACT

The basketball goal support of the present invention need not include the traditional backboard. Rather, this goal support includes a generally U-shaped anchor attachable to a door or similar structure. A hollow cylindrically shaped receptacle is fixed to the anchor for receiving a support tube in close fit within the receptacle. The support tube supports the basketball goal.

5 Claims, 4 Drawing Figures

BASKETBALL GOAL SUPPORT

BACKGROUND OF THE INVENTION

The invention relates to a basketball goal support for use with a basketball goal used to play basketball games. More particularly, the invention relates to a basketball goal support for securement to a door or other similar structure.

Those familiar with basketball are aware that generally the basketball goal is permanently attached to a backboard, which is in turn permanently attached to some type of supporting structure. Because of this permanent arrangement, once a basketball goal has been erected, the playing area becomes essentially dedicated to basketball playing. There is a need, however, for a detachable basketball support structure that can be easily and quickly erected and removed. The present invention provides such a support structure.

The basketball goal support of the present invention need not include the traditional backboard. Rather, this goal support includes a generally U-shaped anchor attachable to a door or similar structure. A hollow cylindrically shaped receptacle is fixed to the anchor for receiving a support tube in close fit within the receptacle. The support tube supports the basketball goal.

It is therefore an object of the present invention to provide a basketball goal support for securement to a door or similar structure.

Another object of the present invention is to provide a basketball goal support that can be secured to either the top or bottom portion of a door or similar structure.

A further object of the present invention is to provide a basketball goal support for securement to a door or similar structure having only a single support tube for supporting the goal.

SUMMARY OF THE INVENTION

These and other objects of the invention are achieved in a basketball goal support having a single support tube attached at one end to the circular rim of the basketball goal and closely fitted within a hollow, cylindrically shaped receptacle at the other end. The receptacle is attached to a bracket capable of securement to a door or other similar structure.

In a preferred embodiment, the basketball goal support is secured to the top portion of a door or other similar fixed structure. In another preferred embodiment, the basketball goal support is secured to the bottom portion of a door or other similar fixed structure.

DESCRIPTION OF THE PREFERRED EMBODIMENT

Figure 1:
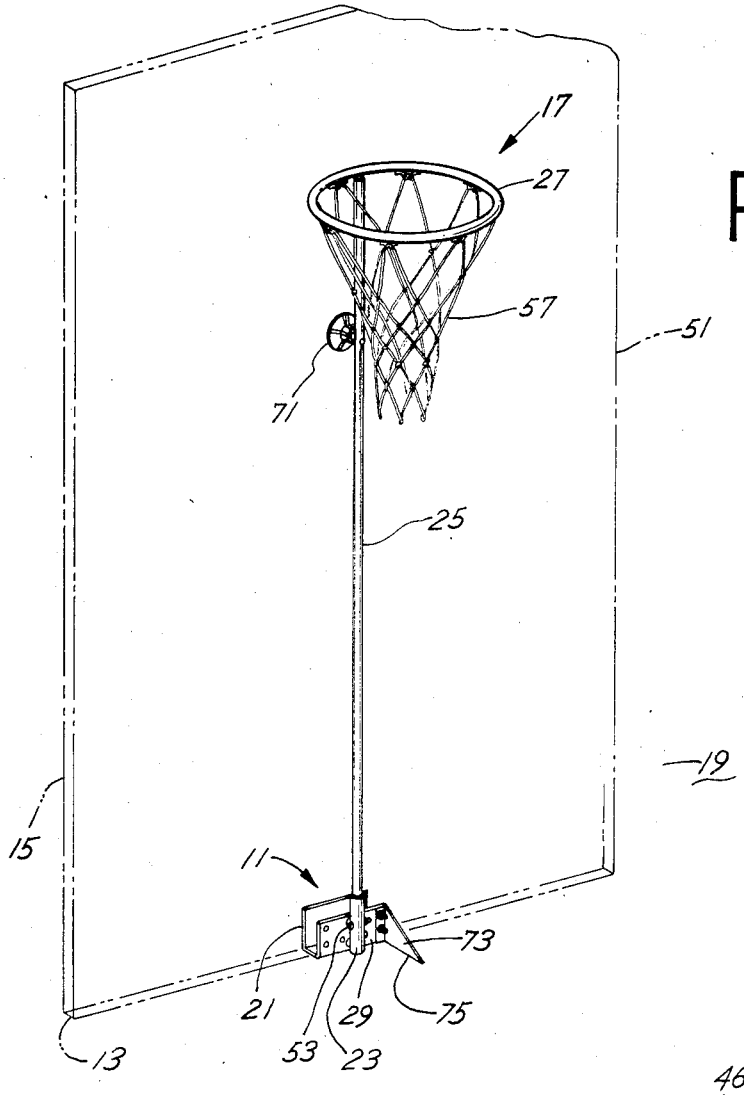
FIG. 1 is a perspective view of a preferred embodiment of a basketball goal support secured to the bottom portion of a door.

Referring to FIG. 1, a support bracket 11 is mounted to the lower edge 13 of a door 15 for supporting a basketball goal 17 above a playing floor, generally indicated by reference numeral 19. Bracket 11 includes a generally U-shaped anchor 21 and a hollow cylindrically shaped receptacle 23 which receives a cylindrically shaped support tube 25. Support tube 25 forms the sole support for the basketball rim 27 of the goal 17.

Figure 2:
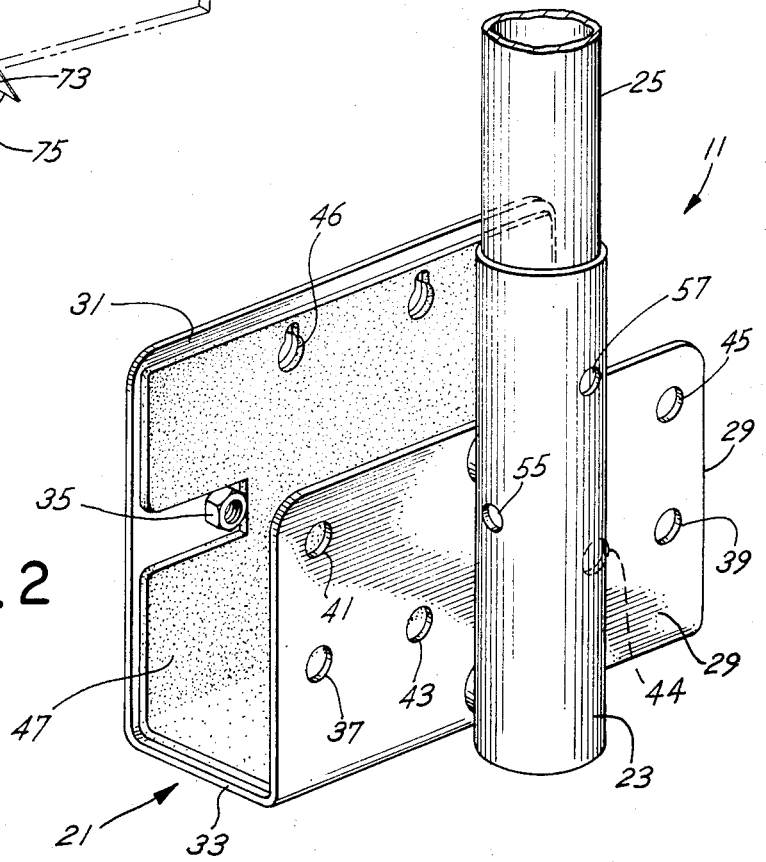
FIG. 2 is a perspective view of a basketball goal support.

As shown in FIG. 2, U-shaped anchor 21 is formed from a rectangular, planar, front plate 29, a rectangular, planar, back plate 31, and a rectangular, planar, connecting plate 33. The front plate 29 and the back plate 31 are secured to the side edges of connecting plate 33 and extend at right angles from the connecting plate in the same direction. As will suggest itself, plates 29, 31, 33 may be formed integral by bending a single piece of metal, or by molding the bracket from hard plastic or other material.

The front and back plates are disposed in parallel relation and are spaced apart sufficiently for receiving the edge of a door or other similar fixed structure. The edge of the door abuts connecting plate 33 when the bracket is in the proper position on the door.

Anchor 21 carries a threaded nut 35 for use to secure the bracket to the door. An opening (not shown) is formed in the back plate behind nut 35 for permitting a bolt (not shown) to enter the nut from outside the back plate. The bolt may be driven from outside back plate 31 and against the door in order to hold the bracket firmly in place. Alternatively, a plastic or steel sheet member may be disposed between the door and the back plate and a screw used to drive the sheet member against the door in a vice-like fashion.

As will suggest itself, other screw bolts may be secured against other openings formed in the back plate, or in the front plate. Also, the openings alone without screw bolts may be utilized to secure the bracket to the door, by the use of wood screws passing through the openings and into the door.

Alternatively, the outer surface of the back plate 31 may be secured against a wall or structure. Key shaped holes 46 (one shown) may be placed in the back plate 31 for receiving a screw head through the larger part of hole 46 (the screw is initially drive into a structure behind the back plate). After the keyhole 46 receives the screwhead, the installer moves the back plate downward for receiving the shank of the screw into the smaller part of hole 46. By making the back plate higher than the front plate, a screwdriver may be used from the frontside of the front plate to tighten the screw against the back plate. After securement to the wall or other structure, a bankboard may be slid between the front and back plates of the bracket and secured into position through holes 43, 44 and 57.

Anchor 21 may also contain a padding 47 formed of foam rubber or the like. Padding 47 is secured to the inner surfaces of the front plate, back plate, and connecting plate for protecting the door from scratches caused by the bracket. The padding may be secured to the plates by any suitable means, for example, an adhesive.

Receptacle 23 is formed with a hollow, cylindrical shaped interior. For example, receptacle 23 may be formed from a pipe. Receptacle 23 is mounted to front plate 29 in a position in which the longitudinal axis of receptacle 23 is disposed in parallel relation to front plate 29 and back plate 31. When the bracket 11 is secured to the door, the axis of the receptacle 10 is also disposed in parallel relation with the line edge 51 (FIG. 1) of the side edge of the door.

The cylindrically shaped support tube 25 is diametrically sized for close fit within receptacle 23. The support tube 25 is held in place within the receptacle 23 by a bolt or other fastener 53 (FIG. 1) which passes through an opening 55 (FIG. 2) and out another opening (not shown) in the receptacle. An additional opening 57 may be formed in receptacle 23 to receive an additional screw from the front of the receptacle if so desired.

Referring to FIG. 1, basketball goal 17 includes a net 57 and circular rim 27. Rim 27 is supported a spaced distance above the floor by support tube 25.

Support tube 25 is elongated in shape having an upper end and a lower end. The upper end of tube 25 is attached to rim 27 and the lower end is attached to bracket 11.

Figure 3:
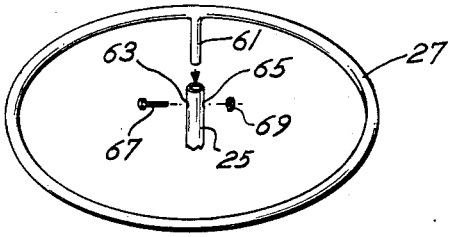
FIG. 3 is a perspective view of an embodiment of a basketball goal.

As shown in FIG. 3, rim 27 includes a support standard 61 which serves as the sole support of the rim. Standard 61 is cylindrically shaped and diametrically sized for close fit within the upper end of support tube 25. Tube 25 includes a pair of openings 63, 65 for receiving a threaded bolt 67. Standard 61 includes a corresponding opening which passes through the standard for receiving bolt 67. A nut 69 holds bolt 67 in place, as understood.

As shown in FIG. 1, a suction cup 71 is secured close to the upper end of the support tube 25 for maintaining the upper end of the tube in a fixed position relative to door 15.

Anchor 21 also includes a detachably mounted brace 73. Brace 73 is mounted to the front plate 29 of the anchor 21 for use when anchor 21 is secured to the bottom edge of the door. Brace 73 includes a lower bracing surface 75 that abuts the playing floor. Brace 73 maintains front plate 29 substantially perpendicular to connecting plate 33. As shown in FIG. 2, openings 37, 41 or 39, 45 may be used to bolt the brace into position.

Figure 4:
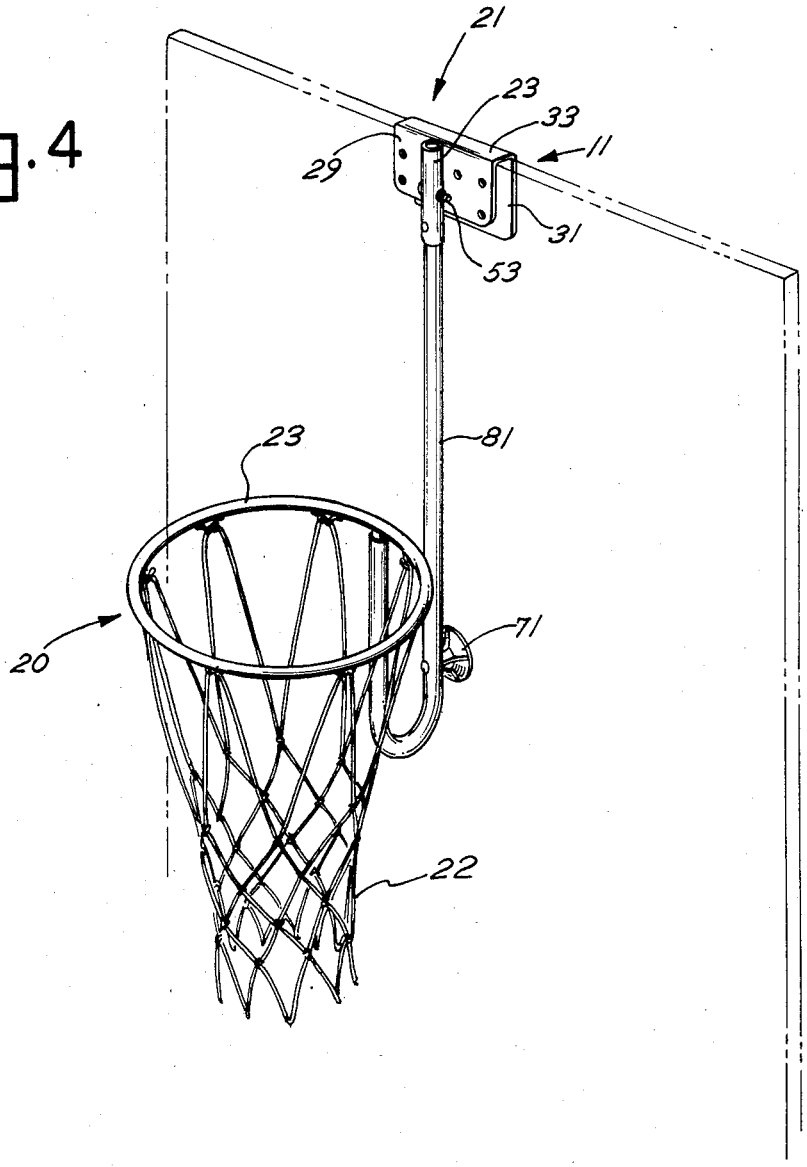
FIG. 4 is a perspective view of a preferred embodiment of a basketball goal support secured to the top portion of a door.

Referring to FIG. 4, bracket 11 also may be secured to the top edge of the door. The basketball goal is supported a spaced distance above the floor by a single J-shaped support tube 81. The single J-shaped support tube 81 is attached at its lower end to the rim 23. The J-shaped support tube 81 extends downwardly from the plane of rim 23 and then back upwardly above rim 23. At its upper end, the J-shaped support tube 16 is attached to bracket 11.

As shown in FIG. 4, bolt 53 is used to secure the J-shaped support tube to the bracket. Additional openings may be provided along the length of J-shaped support tube 81 for adjusting the height of the rim from the playing floor. The openings in the support tube are aligned with corresponding openings in receptacle 23, and support tube 81 may pass through the receptacle as understood.

As will suggest itself, the components of the basketball goal support may be secured together by any conventional means, as for example, screws and bolts, weldments, brackets, etc.

It is to be understood, of course, that the foregoing describes preferred embodiments of the present invention and that modifications may be made therein without departing from the spirit or scope of the present invention as set forth in the appended claims.

What is claimed is:

1. A basketball goal support for securement to a door, or the like comprising:

a generally U-shaped anchoring means formed of a planar front plate, a planar back plate and a planar connecting plate, said front and back plates secured at right angles to and extending from said connecting plate disposing said front and back plates in parallel relation, said front and back plates spaced sufficiently for receiving an edge of a door between the front and back plates with the edge abutting the connecting plate;

a hollow cylindrically shaped receptacle mounted to said front plate disposing the axis of said cylindrical shaped receptacle in a plane parallel with said front and back plate and disposing said axis parallel with the line edge of the side of the door when said receptacle is secured to the door;

a cylindrical shaped support tube diametrically sized for close fit within said receptacle, said support tube of a size for supporting a basketball goal above a playing floor; and securing means carried by said anchoring means for securing said anchoring means to said door.

2. A bracket according to claim 1 and further including a suction cup securing means secured to said support tube for securing said tube to the door.

3. A bracket according to claim 1 and further including a brace detachably mountable to the front plate of said anchoring means for use when said anchoring means is secured to the bottom edge of the door, said brace including a bracing surface for abutting the playing floor for mounting said front plate substantially perpendicular to said connecting plate.

4. A basketball goal support according to claim 1 and further including a basketball goal rigidly connected to said support tube.

5. A bracket according to claim 1 and further including padding means secured to the opposing surfaces of said front and back plate, said padding disposed on said last named surfaces in a position for abutting the door.

* * * * *